US007145118B1

(12) United States Patent
Wu

(10) Patent No.: US 7,145,118 B1
(45) Date of Patent: Dec. 5, 2006

(54) MICROWAVE OVEN PROTECTIVE CIRCUIT ARRANGEMENT

(75) Inventor: Ming-Jing Wu, P.O. Box 108-00403, Taipei 106 (TW)

(73) Assignee: Ming-Jing Wu, Taipei Hsien (TW)

( * ) Notice: Subject to any disclaimer, the term of this patent is extended or adjusted under 35 U.S.C. 154(b) by 7 days.

(21) Appl. No.: 11/161,896

(22) Filed: Aug. 22, 2005

(51) Int. Cl.
*H05B 6/76* (2006.01)

(52) U.S. Cl. ..... 219/737; 219/736

(58) Field of Classification Search ..... 219/737, 219/678, 736, 738, 739, 740, 741, 742, 743, 219/744
See application file for complete search history.

(56) References Cited

U.S. PATENT DOCUMENTS 4,065,655 A * 12/1977 Wong et al. ..... 219/737
4,199,716 A * 4/1980 Reindel ..... 324/95
4,253,005 A * 2/1981 Gordon et al. ..... 219/699
4,256,944 A * 3/1981 Brandon ..... 219/686
4,340,796 A * 7/1982 Yamaguchi et al. ..... 219/713
4,357,513 A * 11/1982 Kawata et al. ..... 219/685
4,370,534 A * 1/1983 Brandon ..... 219/695
4,377,733 A * 3/1983 Yamaguchi et al. ..... 219/713
4,760,229 A * 7/1988 Steers et al. ..... 219/739
6,924,469 B1 * 8/2005 Strong ..... 219/714

* cited by examiner

*Primary Examiner*—Daniel Robinson

(57) ABSTRACT

A microwave oven protective circuit arrangement is disclosed to include a cutoff switch electrically connected between a power supply unit and a microwave oven for controlling the supply of electricity from the power supply unit to the microwave oven, and a detector provided outside the microwave oven to detect leakage of the microwave produced by the microwave oven and to output a cutoff signal to the cutoff switch to cut off electricity from the microwave oven when detected a leakage of the microwave.

7 Claims, 4 Drawing Sheets

MICROWAVE OVEN PROTECTIVE CIRCUIT ARRANGEMENT

BACKGROUND OF THE INVENTION

1. Field of the Invention

The present invention relates to microwave ovens and more particularly, to a microwave oven protective circuit arrangement, which automatically cuts off power supply from the power supply unit to the microwave oven when detected a leakage of the microwave produced by the microwave oven.

2. Description of the Related Art

Following fast development of technology, a variety of high-tech produces have been developed to serve people and to improve our living conditions. In early days, cooking food is achieved by means of making a fire to heat food in a pot, pan, or the like. This cooking method requires much time to cook food. Further, the center part of the food may be not well cooked when the outer part of the food is overroasted. In order to eliminate this problem, microwave ovens are developed. A microwave oven is a kitchen appliance that cooks food by passing an electromagnetic wave through it, and heat is produced by the absorption of microwave energy by the water molecules in the food. The microwave energy produced by a microwave oven is about within 600 W~2000 W that causes water molecules to oscillate at about 24.5 GHz. Therefore, heat produced by the absorption of microwave energy by the water molecules in the food enables the food to be thoroughly cooked within a short time.

A microwave oven can cook food quickly. However, a leakage of the microwave produced by a microwave oven may cause certain cumulative hazards and non-cumulative hazards to the user. It has been well acknowledged by scientists that a leakage of the microwave produced by a microwave oven will cause the following non-cumulative hazards.

1. Hazard to the Eyes

The eyes contain much amount of water. When the water molecules in the eyes absorb a microwave energy from a microwave oven, the limited flow rate of blood in the systems (cornea, lens, etc. of the eyes) cannot quickly carry the produced heat away from the eyes, and the heat energy may cause a severe damage to the eyes.

2. Hazard to the Genetic Organs

When the water molecules in the reproductive organ more particularly the testicle of a male absorb the microwave energy of a microwave oven, the heat thus produced may obstruct the testicle from generating sperm, resulting in infertility of the victim.

3. Hazard to the Skin and Subcutaneous Tissue

Because a microwave can pass through an insulative object, the skin and the subcutaneous tissue may be burned when radiated by the microwave produced by a microwave oven.

FIG. 4 illustrates the outer appearance of a conventional microwave oven. As illustrated, the microwave oven A comprises a housing A1, which defines a heating chamber A11, and a door A2 pivotally coupled to the housing A1 and adapted to close the heating chamber A11. The door A2 comprises a doorframe A21 and a window A22 at the center of the doorframe A21. When cooking, the food is put in the heating chamber A11, and then the door A2 is closed, keeping the heating chamber A11 in an enclosed status. During heating, the user can see the cooking status of the food through the window A22.

In order to isolate the microwave produced by a microwave oven, the door of the microwave oven must be specially designed. Normally, the door of a microwave oven is designed to have a protective metal net, a rubber that carries oxygen, a door sealing system, and a door locking system. According to actual practice, the microwave produced by a microwave oven may leak out of the microwave oven through the gaps in between the housing and the door and the gaps in between the doorframe and the window. After a long use of a microwave oven, the door of the microwave oven may wear mechanically, and gaps may be produced in between the door and the housing. Further, vibration produced upon closing/opening of the door of a microwave oven may result in gaps in the door around the window. These gaps may be no visible to the user; however, the microwave produces by the microwave oven will leak out of the microwave oven through these gaps. When one approaches the microwave oven during cooking, the leaked microwave will cause injury to the body of the person approaching the microwave oven.

Therefore, it is desirable to provide a measure that eliminates the aforesaid problems.

SUMMARY OF THE INVENTION

The present invention has been accomplished under the circumstances in view. It is therefore the main object of the present invention to provide a microwave oven protective circuit arrangement, which detects a leakage of the microwave produced by the microwave oven and automatically cuts off power supply from the power supply unit to the microwave oven upon detection of a leakage of the microwave. To achieve this and other objects of the present invention, the microwave oven protective circuit arrangement comprises a cutoff switch and a detector means. The cutoff switch is electrically connected between a power supply unit and a microwave oven and adapted to control the supply of electricity from the power supply unit to the microwave oven. The detector means is provided outside the microwave oven and electrically connected to the cutoff switch and adapted to detect a leakage of the microwave produced by the microwave oven and to output a cutoff signal to the cutoff switch to cut off electricity from the power supply unit to the microwave oven when detected a leakage of the microwave produced by the microwave oven.

DETAILED DESCRIPTION OF THE PREFERRED EMBODIMENT

Figure 1:
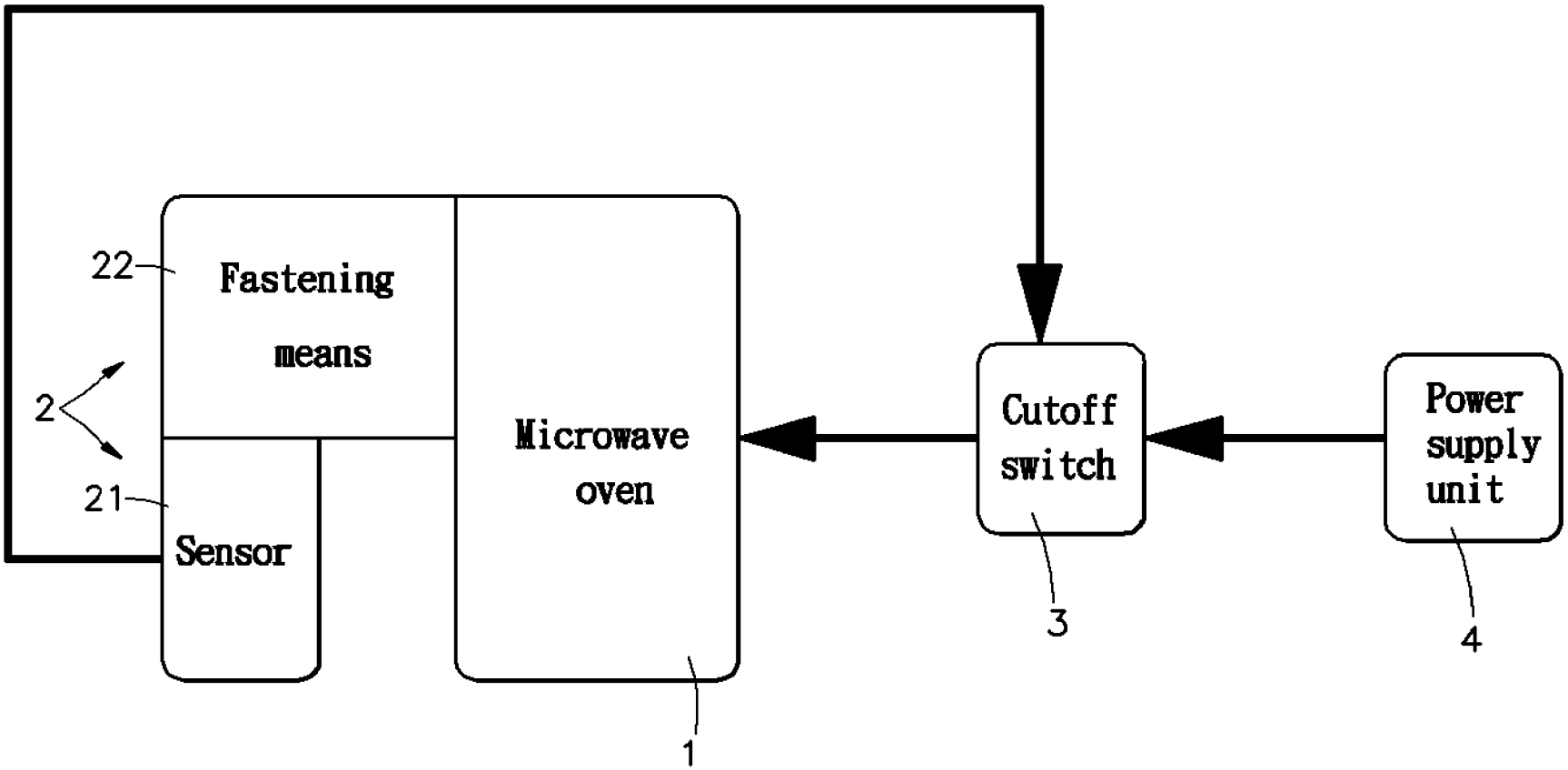
FIG. 1 is a circuit block diagram of a first embodiment of the present invention.

Referring to FIG. 1, a microwave oven protective circuit arrangement in accordance with the first embodiment of the present invention is shown comprised of a microwave oven 1, a detector 2, a cutoff switch 3, and a power supply unit 4.

The microwave oven 1 is controllable to produce a microwave to cook food put therein.

The detector 2 comprises a sensor 21 electrically connected to the cutoff switch 3 and adapted to detect the presence of a microwave, and fastening means 22 adapted to secure the sensor 21 to outside of the microwave oven 1.

The cutoff switch 3 is electrically connected to the microwave oven 1 to control the supply of power supply from the power supply unit 4 to the microwave oven 1 subject to the control of the sensor 21.

The power supply unit 4 is electrically connected to the microwave oven 1 through the cutoff switch 3, and adapted to provide the necessary working electricity to the microwave oven 1.

When the user using the microwave oven 1 to cook food, the cutoff switch 3 keeps transferring electricity from the power supply unit 4 to the microwave oven 1, enabling the microwave oven 1 to produce an electromagnetic wave through the food so that heat is produced by the absorption of microwave energy by the water molecules in the food. During cooking, the sensor 21 detects the presence of a microwave. In case of a leakage of the microwave produced by the microwave oven 1, the sensor 21 will be immediately induced to output a cutoff signal to the cutoff switch 3, causing the cutoff switch 3 to cut off the supply of electricity to the microwave oven 1, and therefore the microwave oven 1 is stopped from producing the microwave.

According to the related internal regulations, the wavelength of a home microwave oven 1 is 122 mm, and the corresponding frequency is 2450 MHz. This specification prevents interference with the electric wave for communication. The sensor 21 is designed to detect the presence of the wavelength or frequency. Upon presence of such a wavelength or frequency, the sensor 21 immediately outputs a cutoff signal to the cutoff switch 3, causing the cutoff switch 3 to cut off the supply of electricity to the microwave oven 1. Therefore, the invention accurately detects the occurrence of a microwave leakage, preventing a false detection due to interference of other electromagnetic waves.

According to the related internal regulations, the microwave leakage amount of a microwave oven 1 must not exceeds by 5 milliwatts per square millimeters. The sensor 21 can be designed subject to this standard. The sensor 21 can also be designed subject to a stricter standard, for example, to output a cutoff signal when detected the presence of an amount of the assigned microwave over 2 milliwatts per square millimeters. Further, the cutoff switch 3 can be a power relay or mechanical relay.

Figure 2:
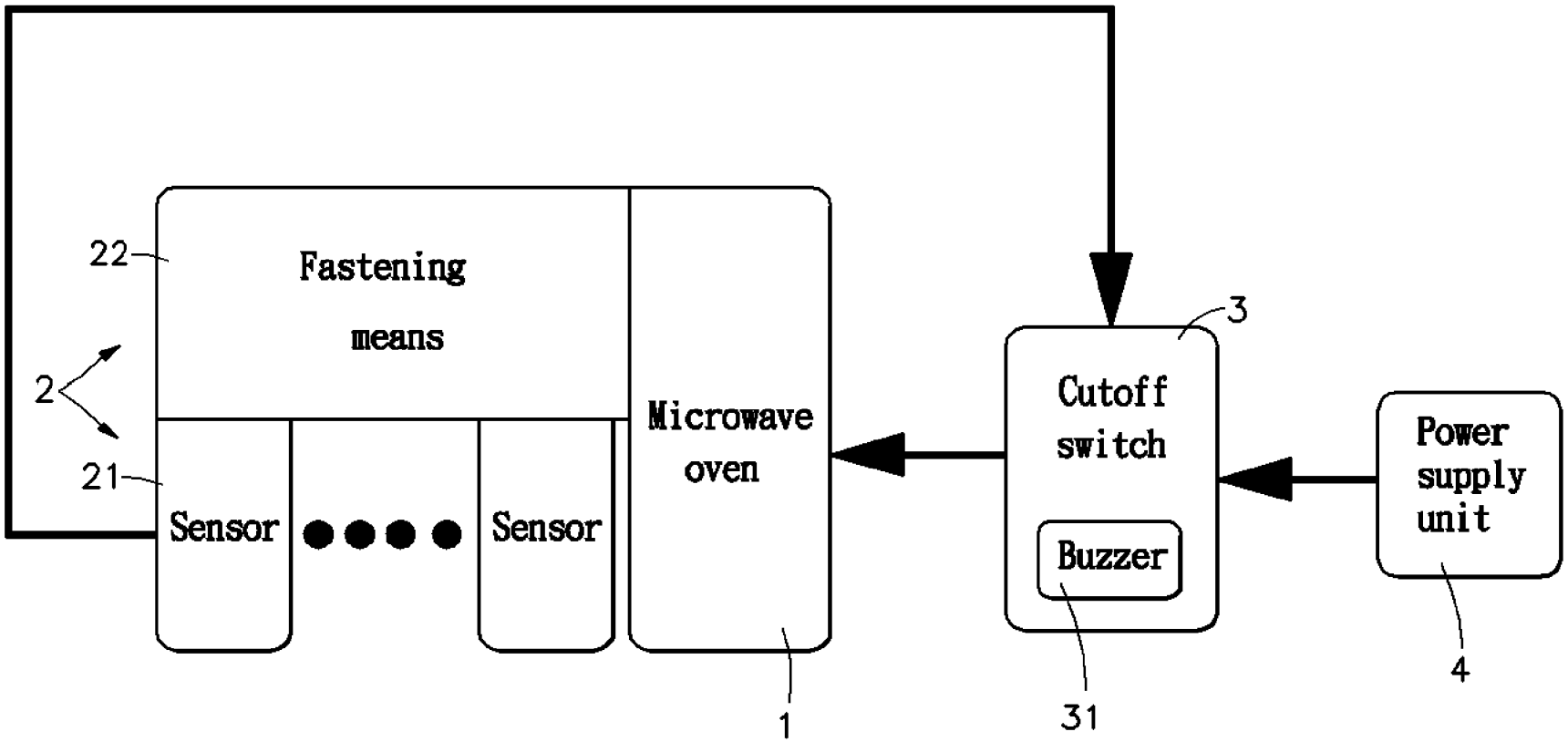
FIG. 2 is a circuit block diagram of a second embodiment of the present invention.

FIG. 2 is a circuit block diagram of a microwave oven protective circuit arrangement according to the second embodiment of the present invention. According to this embodiment, the detector 2 comprises multiple sensors 21 fastened to the outside of the microwave oven 1 at different locations by fastening means 22 to detect the microwave oven 1 in different directions. Further, a buzzer 31 is installed in the cutoff switch 3. When one sensor 21 of the detector 2 is induced to output a cutoff signal to the cutoff switch 3, the cutoff switch 3 cuts off electricity from the microwave oven 1 and simultaneously drives the buzzer 31 to buzz, informing the user about the microwave leakage status of the microwave oven 1.

Figure 3:
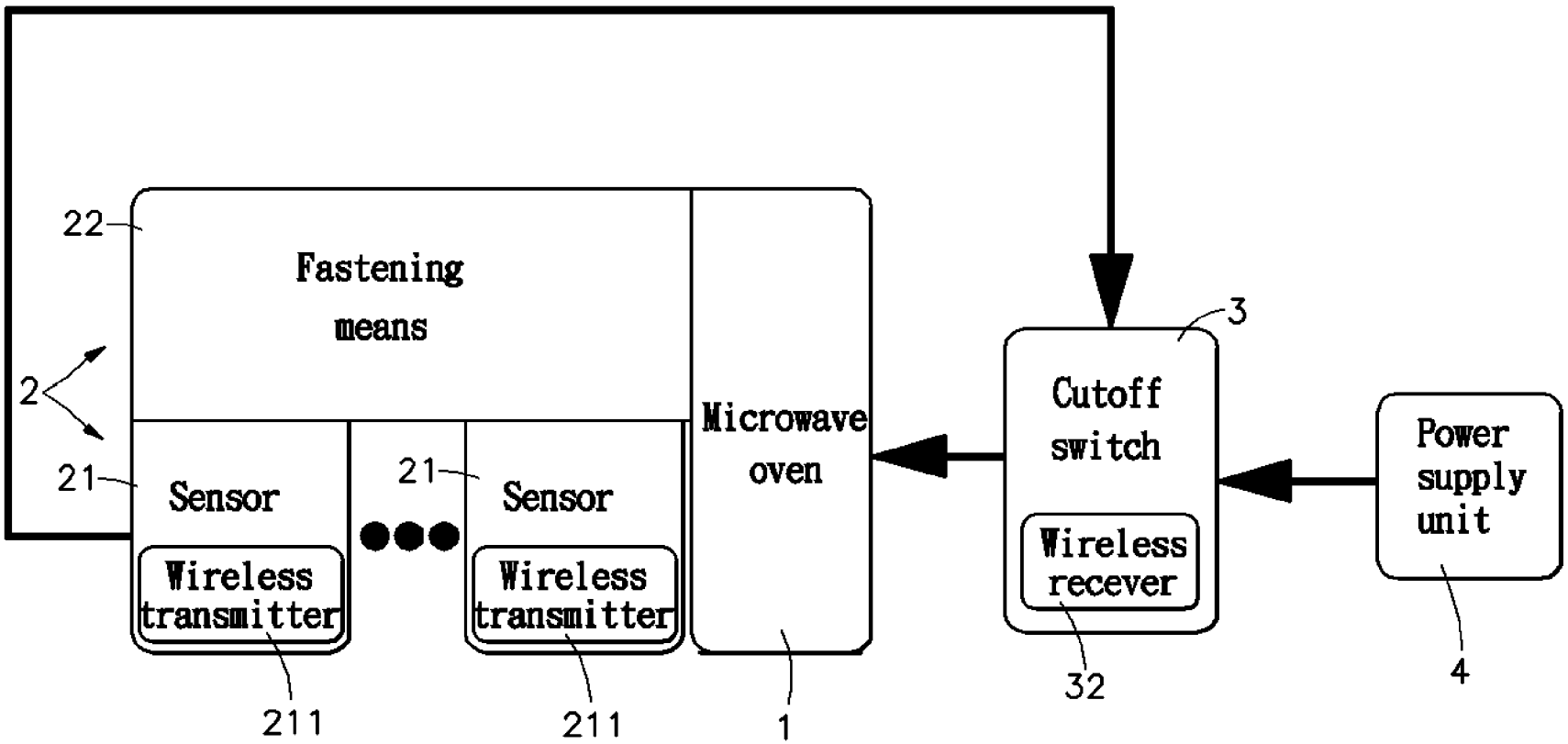
FIG. 3 is a circuit block diagram of a third embodiment of the present invention.
Figure 4:
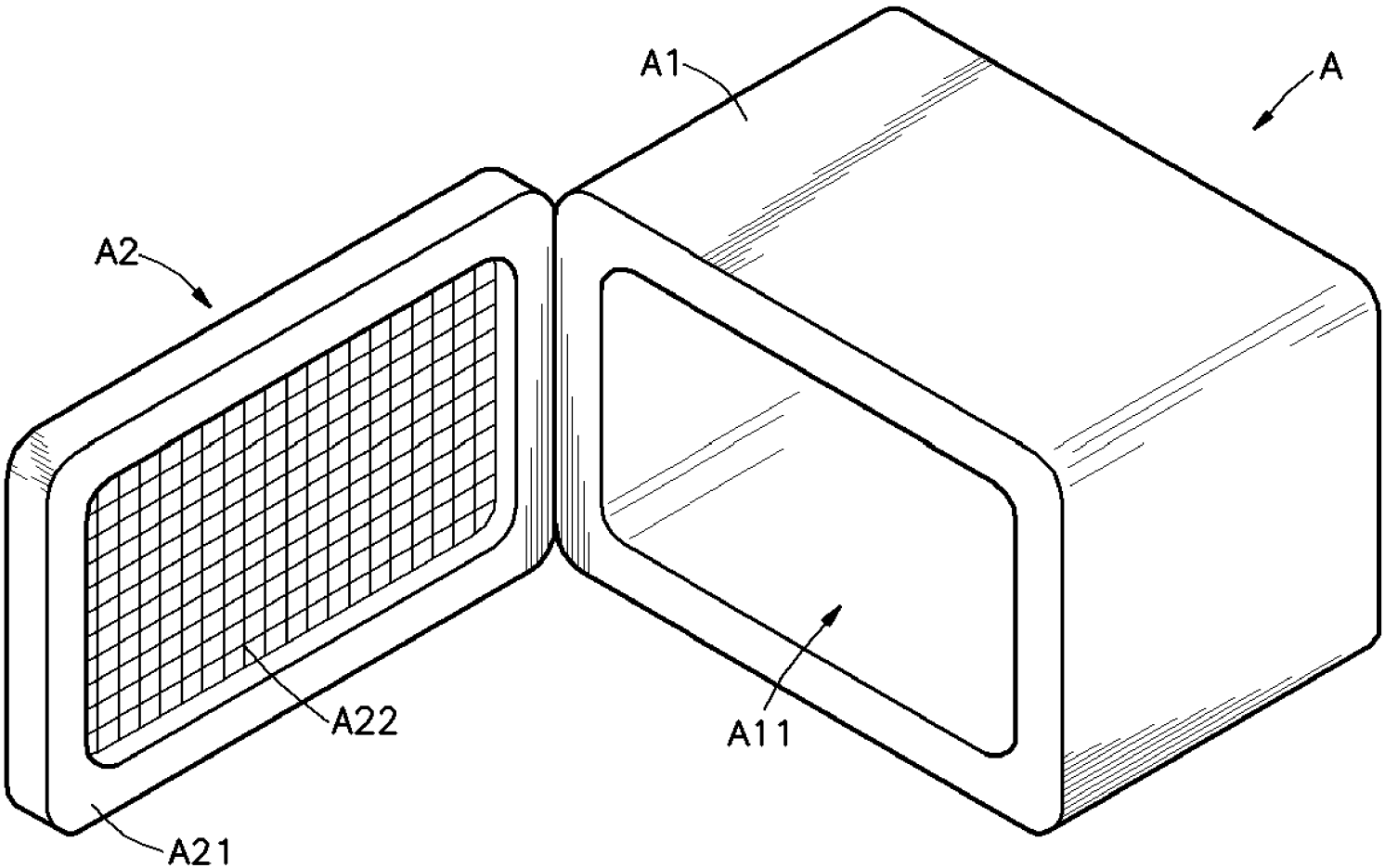
PRIOR ART FIG. 4
FIG. 4 illustrates the outer appearance of a conventional microwave oven.

FIG. 3 is a circuit block diagram of a microwave oven protective circuit arrangement according to the third embodiment of the present invention. According to this embodiment, each sensor 21 of the detector 2 is provided with a wireless transmitter 211, and the cutoff switch 3 is provided with a wireless receiver 32. When one sensor 21 of the detector 2 is induced, it drives the respective wireless transmitter 211 to send a cutoff signal to the cutoff switch 3 wirelessly. Upon receipt of the wireless cutoff signal by the wireless receiver 32, the cutoff switch 3 immediately cuts off electricity from the microwave oven 1. This embodiment enables the user to install the sensors 2 at remote locations around the microwave oven 1.

As indicated above, the invention provides a microwave oven protective circuit arrangement, which uses sensor means to detect a leakage of the microwave produced by the microwave oven, and a cutoff switch to control the supply of electricity to the microwave oven and to automatically cut off electricity from the microwave oven when the sensor means is induced.

A prototype of microwave oven protective circuit arrangement has been constructed with the features of FIGS. 1~3. The microwave oven protective circuit arrangement functions smoothly to provide all of the features discussed earlier.

Although particular embodiments of the invention have been described in detail for purposes of illustration, various modifications and enhancements may be made without departing from the spirit and scope of the invention.

What is claimed is:

1. A microwave oven protective circuit arrangement comprising:

a cutoff switch electrically connected between a power supply unit and a microwave oven and adapted to control the supply of power from said power supply unit to said microwave oven;

detector means provided outside said microwave oven and electrically connected to said cutoff switch and adapted to detect a leakage of the microwave produced by said microwave oven;

wireless transmitter means installed in said detector means and to output a wireless cutoff signal when said detector means detected a leakage of the microwave produced by said microwave oven; and wireless receiver means installed in said cutoff switch and adapted to receive said wireless cutoff signal from said wireless transmitter means and to drive said cutoff switch to cut off power from said microwave oven upon receipt of said wireless cutoff signal.

2. The microwave oven protective circuit arrangement as claimed in claim 1, wherein said detector means comprises at least one sensor respectively electrically connected to said cutoff switch and adapted to detect a leakage of the microwave produced by said microwave oven, and fastening means adapted to fasten each of said at least one sensor to a location outside said microwave oven.

3. The microwave oven protective circuit arrangement as claimed in claim 2, wherein each of said at least one sensor is adjustable to detect the frequency of the microwave produced by said microwave oven within a predetermined range.

4. The microwave oven protective circuit arrangement as claimed in claim 2, wherein each said at least one sensor is adjustable to detect a predetermined amount of the microwave produced by said microwave oven.

5. The microwave oven protective circuit arrangement as claimed in claim 1, wherein said cutoff switch is a power replay.

6. The microwave oven protective circuit arrangement as claimed in claim 1, wherein said cutoff switch is a mechanical relay.

7. The microwave oven protective circuit arrangement as claimed in claim 1, further comprising audio alarm means installed in said cutoff switch and adapted to output an audio warning sound when said wireless receiver means received said cutoff signal from said wireless transmitter means.

* * * * *